US009693640B2

(12) United States Patent
Oakes

(10) Patent No.: US 9,693,640 B2
(45) Date of Patent: Jul. 4, 2017

(54) FRONT LOADING CUTLERY DISPENSER

(71) Applicant: Dixie Consumer Products LLC, Atlanta, GA (US)

(72) Inventor: Shawn Allen Oakes, Ripon, WI (US)

(73) Assignee: DIXIE CONSUMER PRODUCTS LLC, Atlanta, GA (US)

( * ) Notice: Subject to any disclaimer, the term of this patent is extended or adjusted under 35 U.S.C. 154(b) by 0 days.

(21) Appl. No.: 14/454,355

(22) Filed: Aug. 7, 2014

(65) Prior Publication Data

US 2015/0041484 A1 Feb. 12, 2015

Related U.S. Application Data

(60) Provisional application No. 61/863,484, filed on Aug. 8, 2013.

(51) Int. Cl.

| | |
|---|---|
| ***A47F 10/06*** | (2006.01) |
| ***A47F 1/12*** | (2006.01) |
| *A47F 1/10* | (2006.01) |

(52) U.S. Cl.

CPC ..... *A47F 1/126* (2013.01); *A47F 10/06* (2013.01); *A47F 2001/103* (2013.01)

(58) Field of Classification Search

CPC ..... A47F 1/126

See application file for complete search history.

(56) References Cited

U.S. PATENT DOCUMENTS

| | | | |
|---|---|---|---|
| 46,832 | A | 3/1865 | Thorne |
| 592,105 | A | 10/1897 | Barnes |
| D32,913 | S | 7/1900 | Graf |
| 703,718 | A | 7/1902 | Cammann |
| 716,058 | A | 12/1902 | Lang et al. |
| 925,485 | A | 6/1909 | Lafler |
| 999,837 | A | 8/1911 | Morris et al. |
| 1,053,387 | A | 2/1913 | Hawley |
| 1,146,447 | A | 7/1915 | Prommel |
| 1,182,793 | A | 5/1916 | Richardson |
| 1,259,927 | A | 3/1918 | Swift |
| 1,261,835 | A | 4/1918 | Martin |
| 1,353,109 | A | 9/1920 | Carr |
| 1,355,583 | A | 10/1920 | Zeidler et al. |
| 1,482,071 | A | 1/1924 | Duff et al. |
| 1,497,585 | A | 6/1924 | Poole |

(Continued)

FOREIGN PATENT DOCUMENTS

| | | | |
|---|---|---|---|
| CA | 2545745 | A1 | 11/2006 |
| CN | 2865478 | Y | 2/2007 |

(Continued)

OTHER PUBLICATIONS

Peel Adhesion for Single Coated Pressure-Sensitive Tapes 180 Angle, Aug. 1989, pp. 21-22.

(Continued)

*Primary Examiner* — Gene Crawford

*Assistant Examiner* — Ayodeji Ojofeitimi

(57) ABSTRACT

The present application provides a cutlery dispenser for use with a number of cutlery utensils. The cutlery dispenser may include a housing and a front cover. The front cover may include a dispensing opening and a spring loaded retainer such that the cutlery utensils may be loaded through the front cover and may be dispensed therefrom.

20 Claims, 11 Drawing Sheets

(56) References Cited

U.S. PATENT DOCUMENTS 1,504,098 A 8/1924 Cathey
1,546,077 A 7/1925 Hunter et al.
1,547,151 A 7/1925 Watling
1,560,938 A 11/1925 Lund
1,577,302 A 3/1926 Schultz
1,610,001 A 12/1926 Foster
1,635,386 A 7/1927 Pierson
1,675,510 A 7/1928 Nolan
1,767,634 A 6/1930 Weiss
1,821,377 A 3/1931 Cusick
1,886,378 A 11/1932 George
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A 1/1942 Hopkins et al.
2,328,486 A 8/1943 Painter
2,340,561 A 2/1944 Renfro
2,497,718 A 1/1945 Earley et al.
2,401,534 A 6/1946 Welch
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,503,741 A 4/1950 Johnson
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,965,262 A 9/1955 Du Bois
2,752,678 A 7/1956 Welch
2,771,214 A 11/1956 Lefebvre
2,800,013 A 7/1957 George
2,806,634 A 9/1957 Baumgartner
2,824,369 A 2/1958 Welch
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,881,247 A 4/1959 Levine et al.
2,889,076 A 6/1959 Van Schie
2,907,512 A 10/1959 Leone
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
3,021,919 A 2/1962 Peters
3,037,257 A 6/1962 Girodet
3,052,006 A 9/1962 Jonas
3,083,879 A 4/1963 Coleman
3,095,114 A 6/1963 Tobias
3,100,842 A 8/1963 Tellefsen
3,114,475 A 12/1963 Etes
3,115,989 A 12/1963 Strang
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,191,802 A 6/1965 Lasting
3,217,954 A 11/1965 Grant et al.
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,325,050 A 6/1967 Wanamaker
3,334,784 A 8/1967 Morrison
3,338,471 A 8/1967 De Good
3,371,821 A 3/1968 Abood et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Albert
3,499,538 A 3/1970 Sherard
3,558,006 A 1/1971 Redmond et al.
3,587,922 A 6/1971 Oriti
3,593,908 A 7/1971 Desmond et al.
3,654,396 A 4/1972 Biezeveld
3,679,096 A 7/1972 Musser
3,680,736 A 8/1972 Wiessmann
3,709,403 A 1/1973 Harriman
3,710,535 A 1/1973 Walter
3,741,410 A 6/1973 Henschke et al.
3,747,803 A 7/1973 Zoepf et al.
3,786,959 A 1/1974 Greb et al.
3,851,762 A 12/1974 Liblick
3,854,625 A * 12/1974 Kuebler ..... B65D 83/0409 221/198
3,861,563 A 1/1975 Lisbin
3,862,702 A 1/1975 Johnson
3,897,886 A 8/1975 Franklin
3,932,978 A 1/1976 Kinney
3,944,128 A 3/1976 Hogan et al.
3,972,118 A 8/1976 Richard
3,987,901 A 10/1976 Dullinger
3,998,238 A 12/1976 Nigro
4,005,801 A 2/1977 Musser et al.
4,043,203 A 8/1977 Montesi
4,048,915 A 9/1977 Martin
4,091,915 A 5/1978 Claasen
4,120,662 A 10/1978 Fosslien
4,134,519 A 1/1979 Barnett et al.
4,146,123 A 3/1979 Cottrell
4,271,999 A 6/1981 Stravitz
4,288,003 A 9/1981 Fries
4,308,974 A 1/1982 Jones
4,317,284 A 3/1982 Prindle
4,382,514 A 5/1983 Williams et al.
4,387,831 A 6/1983 Mcnally
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson et al.
4,614,004 A 9/1986 Oshida
4,624,616 A 11/1986 Freese et al.

(56) References Cited

U.S. PATENT DOCUMENTS 4,638,921 A 1/1987 Sigl et al.
4,662,536 A 5/1987 Powers
4,666,037 A 5/1987 Weissman et al.
4,666,060 A 5/1987 Bouldin
4,676,504 A * 6/1987 Ponza ..... A63B 69/40 124/38
4,691,811 A 9/1987 Arakawa et al.
4,697,673 A 10/1987 Omata
4,707,251 A 11/1987 Jenkins et al.
4,715,514 A 12/1987 Vidondo
4,789,064 A 12/1988 Segal
4,793,539 A 12/1988 Haenni et al.
4,807,753 A 2/1989 Goldstein
4,835,864 A 6/1989 Tang
4,863,033 A 9/1989 Buj
4,884,718 A 12/1989 Leahy
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes
4,961,684 A 10/1990 Provan et al.
4,963,072 A 10/1990 Miley et al.
RE33,447 E 11/1990 Rosman
4,973,037 A 11/1990 Holbrook
4,986,442 A 1/1991 Hinterreiter
4,989,730 A 2/1991 Lemoine et al.
4,995,154 A 2/1991 Bamber
5,012,927 A 5/1991 Borst et al.
D318,600 S 7/1991 Lillelund et al.
5,054,640 A 10/1991 Tucker et al.
5,054,649 A 10/1991 Lemaire et al.
5,064,093 A 11/1991 Davis et al.
5,080,257 A 1/1992 Carnisio
5,127,546 A 7/1992 Chen
5,131,586 A 7/1992 Capy
5,156,266 A 10/1992 Sykora et al.
5,161,268 A 11/1992 Harrow
5,176,494 A 1/1993 Nigrelli et al.
5,191,997 A 3/1993 Squitieri
5,199,756 A 4/1993 Bartlett et al.
5,211,267 A 5/1993 Clark
D336,047 S 6/1993 Kim
5,249,705 A 10/1993 Gates
5,263,596 A 11/1993 Williams
D342,648 S 12/1993 Cautereels et al.
5,269,397 A 12/1993 Kawamoto et al.
5,288,361 A 2/1994 Konno
5,305,875 A 4/1994 Meyer et al.
5,325,992 A 7/1994 Schmid et al.
5,327,650 A 7/1994 Rojas
D351,085 S 10/1994 Schmidt
5,353,935 A 10/1994 Yeager et al.
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,579,910 A 12/1996 Bennett
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A 5/1999 De Schutter
5,921,408 A 7/1999 Groenewold et al.
5,933,918 A 8/1999 Wallays
5,950,842 A 9/1999 Baur
5,961,021 A 10/1999 Koike et al.
D420,887 S 2/2000 Chen
6,021,919 A 2/2000 Kelly
6,023,908 A 2/2000 Vetsch
6,023,913 A 2/2000 Gray et al.
D422,431 S 4/2000 Goins
6,047,830 A 4/2000 Chang
6,062,424 A 5/2000 Simile-Gravina et al.
6,073,795 A 6/2000 Longstreth
6,076,670 A * 6/2000 Yeranossian ..... A47F 1/126 206/362
6,085,916 A 7/2000 Kovacevic et al.
6,098,379 A 8/2000 Spatafora et al.
6,115,921 A 9/2000 Garneau
6,134,790 A 10/2000 Watson
6,202,891 B1 3/2001 Mark
6,226,845 B1 5/2001 Fink
6,250,495 B1 6/2001 Bando
6,250,498 B1 6/2001 Lovejoy
6,257,443 B1 * 7/2001 LaCount ..... A47K 10/427 221/35
6,289,889 B1 9/2001 Bell et al.
6,298,960 B1 10/2001 Derr
6,336,568 B1 1/2002 Tucker et al.
6,378,729 B1 4/2002 Kodama
D458,070 S 6/2002 Bennett et al.
6,399,079 B1 6/2002 Mehta et al.
6,412,398 B1 7/2002 Norcross et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 9/2004 Renard
6,786,359 B1 9/2004 Schroeder
6,832,694 B2 12/2004 Goeking et al.
6,832,698 B1 12/2004 Dybul
6,837,028 B1 1/2005 Miano et al.
6,840,353 B2 1/2005 Arisaka
6,840,420 B1 1/2005 Hudson
6,863,173 B2 3/2005 Bennett
6,880,211 B2 4/2005 Jackson et al.
6,895,672 B2 5/2005 Conforti
6,945,427 B2 9/2005 Hieb
6,951,266 B2 10/2005 Tournier
6,972,033 B2 12/2005 McNicholas
6,976,348 B1 12/2005 Miano et al.
7,013,568 B2 3/2006 Schmidt
7,076,932 B2 7/2006 Rubin
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,204,406 B2 4/2007 Bone et al.
7,210,279 B1 5/2007 Ahmed et al.
7,237,700 B2 7/2007 Bulovic
7,249,793 B1 7/2007 Jabr et al.
7,258,233 B2 8/2007 Lee et al.
7,322,172 B2 1/2008 Hoffman et al.
D564,819 S 3/2008 Fosburg et al.
7,412,808 B2 8/2008 Lavi
7,424,957 B1 * 9/2008 Luberto ..... A47F 1/126 211/59.3
7,434,692 B2 10/2008 Ginsberg et al.
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,690,518 B2 * 4/2010 Fincher ..... A47F 1/12 211/59.2
7,716,842 B2 5/2010 Sumner-Trivisani et al.
7,731,899 B2 6/2010 Talmer et al.

(56) References Cited

U.S. PATENT DOCUMENTS

| | | | |
|---|---|---|---|
| 7,819,234 | B2 | 10/2010 | Herzog |
| 7,856,722 | B2 | 12/2010 | Lago-Arenas |
| D631,337 | S | 1/2011 | Prevost |
| 8,070,013 | B2 | 12/2011 | Reinsel et al. |
| 8,083,058 | B2 | 12/2011 | Marcinkowski et al. |
| 8,083,097 | B2 | 12/2011 | Kaufman et al. |
| 8,152,004 | B2 | 4/2012 | Smith et al. |
| 8,210,364 | B2 | 7/2012 | Smith et al. |
| 8,272,533 | B1 | 9/2012 | D'Amelia et al. |
| 8,296,957 | B2 | 10/2012 | Muehlemann |
| 8,297,473 | B2 | 10/2012 | Smith |
| 8,302,269 | B2 | 11/2012 | Pitman |
| 8,360,273 | B2 | 1/2013 | Reinsel et al. |
| 8,444,006 | B2 | 5/2013 | Dixon |
| 8,480,954 | B2 | 7/2013 | Talmer et al. |
| 8,776,379 | B2 | 7/2014 | Walters et al. |
| 8,839,522 | B2 | 9/2014 | Walters et al. |
| 8,844,798 | B2 | 9/2014 | Linkel |
| D772,514 | S | 11/2016 | Wang |
| 2001/0007308 | A1 | 7/2001 | Glassman et al. |
| 2001/0025856 | A1 | 10/2001 | Lefevre Du Grosriez et al. |
| 2002/0112445 | A1 | 8/2002 | Scaduto |
| 2003/0015824 | A1 | 1/2003 | Forbes et al. |
| 2003/0098344 | A1 | 5/2003 | Blake et al. |
| 2004/0045398 | A1 | 3/2004 | Hayashi |
| 2004/0045860 | A1 | 3/2004 | Edgerly et al. |
| 2004/0089670 | A1 | 5/2004 | Goeking et al. |
| 2004/0237311 | A1 | 12/2004 | Brown et al. |
| 2005/0035136 | A1 | 2/2005 | Dathe et al. |
| 2005/0082307 | A1 | 4/2005 | Tucker |
| 2005/0116482 | A1 | 6/2005 | Harris et al. |
| 2005/0155186 | A1 | 7/2005 | McGuyer et al. |
| 2005/0155229 | A1 | 7/2005 | Lee |
| 2005/0211722 | A1 | 9/2005 | Runnels |
| 2005/0252057 | A1 | 11/2005 | Lavi |
| 2006/0000190 | A1 | 1/2006 | Behnke et al. |
| 2006/0042986 | A1 | 3/2006 | Simkowski et al. |
| 2006/0053638 | A1 | 3/2006 | Sumner-Trivisani et al. |
| 2006/0218795 | A1 | 10/2006 | Santa Cruz et al. |
| 2006/0249531 | A1 | 11/2006 | Litchfield et al. |
| 2007/0035943 | A1 | 2/2007 | Wang |
| 2007/0108141 | A1* | 5/2007 | Smith ..... A47F 1/10 211/49.1 |
| 2007/0131705 | A1 | 6/2007 | Behravesh et al. |
| 2007/0193968 | A1 | 8/2007 | Smith et al. |
| 2007/0214650 | A1 | 9/2007 | Tomazini |
| 2007/0250391 | A1 | 10/2007 | Prade et al. |
| 2008/0118609 | A1 | 5/2008 | Harlfinger et al. |
| 2008/0121650 | A1 | 5/2008 | Smith |
| 2008/0128445 | A1 | 6/2008 | Huang et al. |
| 2009/0194557 | A1 | 8/2009 | Van Deursen |
| 2010/0084418 | A1 | 4/2010 | Reinsel et al. |
| 2010/0147869 | A1 | 6/2010 | Iliffe et al. |
| 2010/0170915 | A1 | 7/2010 | Reinsel et al. |
| 2011/0180562 | A1 | 7/2011 | Reinsel et al. |
| 2011/0226797 | A1 | 9/2011 | Reinsel et al. |
| 2011/0296693 | A1 | 12/2011 | Oakes |
| 2012/0036724 | A1 | 2/2012 | Walters |
| 2012/0047744 | A1 | 3/2012 | Walters |
| 2012/0080444 | A1 | 4/2012 | Smith et al. |
| 2012/0110746 | A1 | 5/2012 | Serrano et al. |
| 2012/0145734 | A1 | 6/2012 | Walters |
| 2012/0145735 | A1 | 6/2012 | Erickson et al. |
| 2012/0145736 | A1* | 6/2012 | Walters ..... A47F 1/10 221/1 |
| 2013/0032609 | A1 | 2/2013 | Righetti et al. |
| 2013/0043272 | A1 | 2/2013 | Oakes |
| 2013/0126548 | A1 | 5/2013 | Pourian et al. |
| 2013/0134211 | A1 | 5/2013 | Linkel |
| 2013/0152406 | A1 | 6/2013 | McFarland |
| 2013/0193157 | A1 | 8/2013 | Jongen et al. |
| 2014/0069930 | A1 | 3/2014 | Oakes |
| 2014/0117036 | A1 | 5/2014 | Smith et al. |
| 2014/0191024 | A1 | 7/2014 | Wnek et al. |
| 2014/0217112 | A1 | 8/2014 | Young et al. |
| 2014/0299656 | A1 | 10/2014 | Wintermute |
| 2015/0028045 | A1 | 1/2015 | Oakes et al. |
| 2015/0028046 | A1 | 1/2015 | Oakes et al. |
| 2015/0041363 | A1 | 2/2015 | Freeman et al. |
| 2015/0048108 | A1 | 2/2015 | Borke |
| 2015/0265108 | A1* | 9/2015 | Brickl ..... A47K 10/422 221/45 |

FOREIGN PATENT DOCUMENTS

| | | | |
|---|---|---|---|
| CN | 101495015 | A | 7/2009 |
| DE | 7033238 | U | 11/1970 |
| DE | 7127677 | | 11/1971 |
| DE | 3151268 | A1 | 7/1983 |
| DE | 4139938 | A1 | 6/1993 |
| DE | 202005013647 | U1 | 7/2006 |
| EP | 0257109 | A1 | 8/1986 |
| EP | 0286538 | A1 | 10/1988 |
| EP | 0856272 | A3 | 1/1999 |
| EP | 1022107 | A1 | 7/2000 |
| EP | 1217923 | B1 | 9/2003 |
| EP | 1358827 | A2 | 11/2003 |
| EP | 1213985 | B1 | 6/2004 |
| EP | 1514497 | A1 | 3/2005 |
| EP | 1719438 | A1 | 11/2006 |
| EP | 1864596 | A2 | 12/2007 |
| FR | 2889507 | A1 | 2/2007 |
| JP | H06121727 | A | 5/1994 |
| JP | 08011934 | A | 1/1996 |
| JP | 08-047440 | | 2/1996 |
| JP | 3042582 | U | 10/1997 |
| JP | 2001354214 | A | 12/2001 |
| JP | 2004261336 | A | 9/2004 |
| JP | 2007319493 | A | 12/2007 |
| KR | 20-1991-0008085 | | 10/1991 |
| KR | 10-2009-0071515 | A | 7/2009 |
| KR | 100954569 | B1 | 4/2010 |
| TW | M287639 | U | 2/2006 |
| TW | M293720 | U | 7/2006 |
| WO | 2004028309 | A1 | 4/2004 |
| WO | 2007049982 | A1 | 5/2007 |
| WO | 2009137367 | A2 | 11/2009 |

OTHER PUBLICATIONS

Tack Rolling Ball, Aug. 1989, pp. 29-30.

Holding Power of Pressure-Sensitive Tape, Aug. 1989, pp. 31-33.

European Search Report for 060009258.2, mailed Jul. 24, 2006, five mages, Munich, Germany.

International Search Report and Written Opinion for PCT/US2011/044931, mailed Feb. 28, 2012.

International Search Report and Written Opinion for PCT/US2011/044934, mailed Mar. 6, 2012.

International Search Report and Written Opinion for PCT/US2011/064057, dated Feb. 29, 2012.

PCT International Search Report and Written Opinion PCT/US2007/083752, Mar. 11, 2008, 10 pages.

PCT International Search Report and Written Opinion PCT/US2007/083922 mailed Nov. 17, 2008, 10 pages.

Supplementary European Search Report for EP 11 79 3088 dated Sep. 25, 2013.

European Search Report for EP 08 014 387.8, mailed Nov. 11, 2008, four pages, European Patent Office, Munich, Germany.

International Search Report and Written Opinion for PCT/US2011/058329; dated Feb. 29, 2012.

International Search Report and Written Opinion for PCT/US2011/058767 mailed Feb. 29, 2012.

International Search Report and Written Opinion for PCT/US2009/059915, mailed Feb. 3, 2010, 13 pages, European Patent Office, Munich, Germany.

International Search Report and Written Opinion for PCT/US2010/000051, mailed Aug. 16, 2010, 6 pages.

International Searching Authority, "International Search Report and Written Opinion for PCT/US2014/047463", mailed Nov. 26, 2014, 22 pages, Korean Intellectual Property Office, South Korea.

(56) References Cited

OTHER PUBLICATIONS

International Searching Authority, "International Search Report and Written Opinion for PCT/US2014/050166", mailed Nov. 20, 2014, 11 pages, Korean Intellectual Property Office, South Korea.
International Searching Authority, "International Search Report and Written Opinion for PCT/US2014/050169", mailed Jan. 9, 2015, 11 pages, Korean Intellectual Property Office, South Korea.
International Searching Authority, "International Search Report and Written Opinion for PCT/US2014/051632", mailed Dec. 3, 2014, 9 pages, Korean Intellectual Property Office, South Korea.
International Searching Authority, "International Search Report and Written Opinion for PCT/US2014/051639", mailed Dec. 9, 2014, 9 pages, Korean Intellectual Property Office, South Korea.
Supplementary European Search Report for European App. No. EP 14 83 4671.1, mailed by the European Patent Office on Feb. 16, 2017.

* cited by examiner

FRONT LOADING CUTLERY DISPENSER

FIELD OF THE DISCLOSURE

The present application relates generally to dispensers for cutlery utensils and more particularly relates to a front loading cutlery dispenser with a front cover having spring loaded retainers for ease of loading and dispensing the cutlery utensils therefrom.

BACKGROUND

Restaurants and other types of retail outlets often provide cutlery utensils in open self-serve dispensing bins. Consumers may retrieve a fork, a spoon, a knife, a spork, and the like directly therefrom. Such open dispensing bins, however, may have at least the appearance of being somewhat unhygienic in that the cutlery utensils are not enclosed. Consumers may react negatively in that the remaining utensils thus may be touched or otherwise contacted while a selected utensil is being removed from the dispensing bin.

To address these concerns relating to the cutlery utensils, enclosed cutlery dispensers have been used. The cutlery utensils may be placed in a utensil compartment and may be dispensed one at a time on command. Generally described, these dispensers may operate via a dispensing lever, a rotating belt, and/or other type of dispensing mechanism. The mechanics of these dispensers, however, may be complex and hence may be subject to malfunction. Further these dispensers typically may be somewhat bulky and may occupy a significant footprint on an already crowded countertop and the like.

There is thus a desire for an improved dispenser for cutlery utensils and the like. Preferably such an improved dispenser may be easy and hygienic to load and to dispense the cutlery utensils therefrom with a reduced overall footprint and simplified mechanics.

SUMMARY

The present application thus provides a cutlery dispenser for use with a number of cutlery utensils. The cutlery dispenser may include a housing and a front cover. The front cover may include a dispensing opening and a spring loaded retainer such that the cutlery utensils may be loaded through the front cover and may be dispensed therefrom.

The present application further provides a method of dispensing cutlery utensils from a dispenser. The method may include the steps of arranging the cutlery utensils in a stack via a joinder member, pushing the stack into a front cover of the dispenser, pivoting a retainer into a first position along the front cover while the stack is pushed therein, pivoting the retainer into a second position once the stack is within the dispenser, removing the joinder member from the stack, and dispensing the cutlery utensils through the front cover.

The present application further provides a cutlery dispenser. The cutlery dispenser may include a housing, a stack of cutlery utensils, a dispensing opening, and a retainer positioned about the dispensing opening such that the stack of cutlery utensils may be loaded through the dispensing opening and may be dispensed therefrom.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
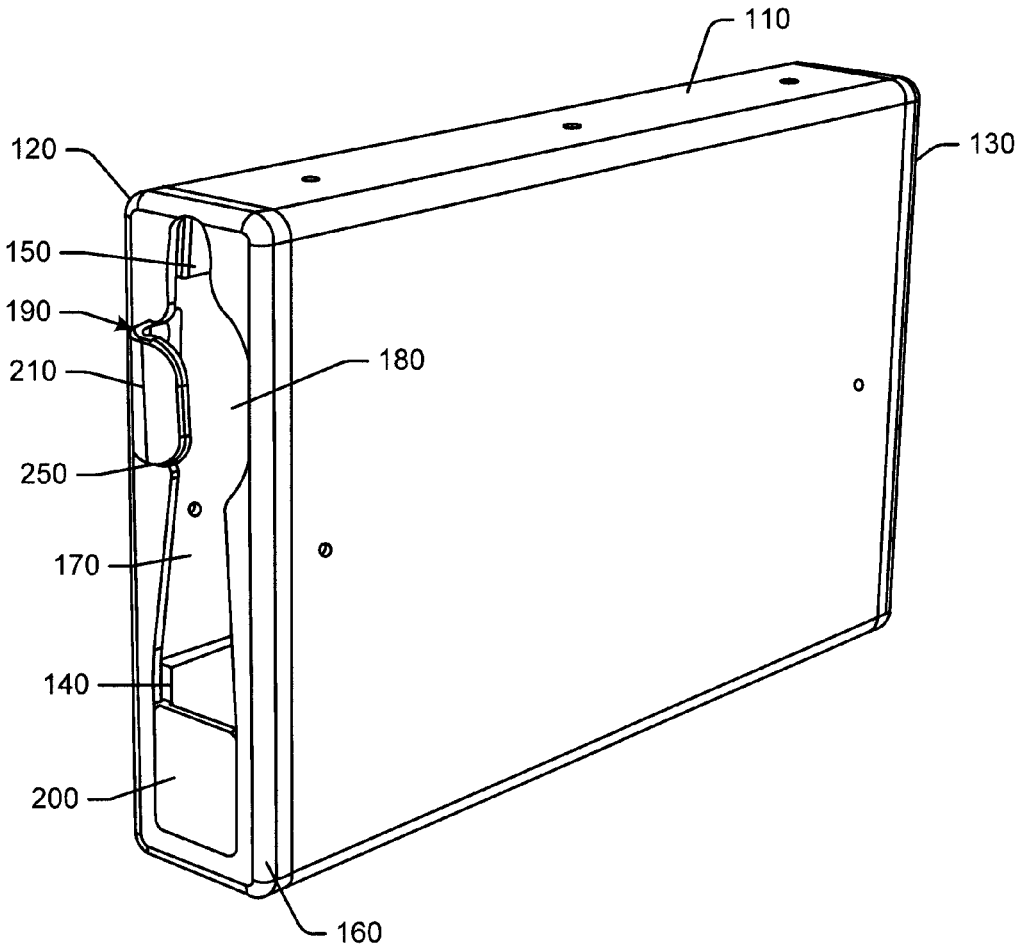
FIG. 1 is a perspective view of a cutlery dispenser as may be described herein.
Figure 2:
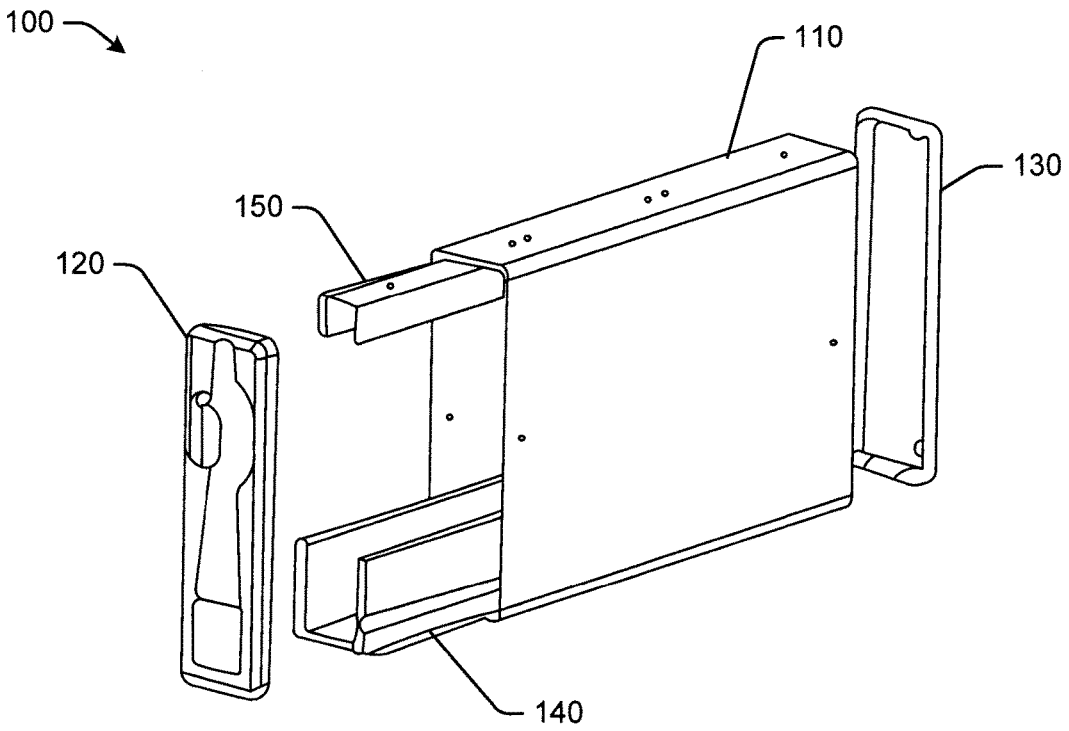
FIG. 2 is an exploded view of the cutlery dispenser of FIG. 1 showing a housing, a front cover, and an end cap.
Figure 3:
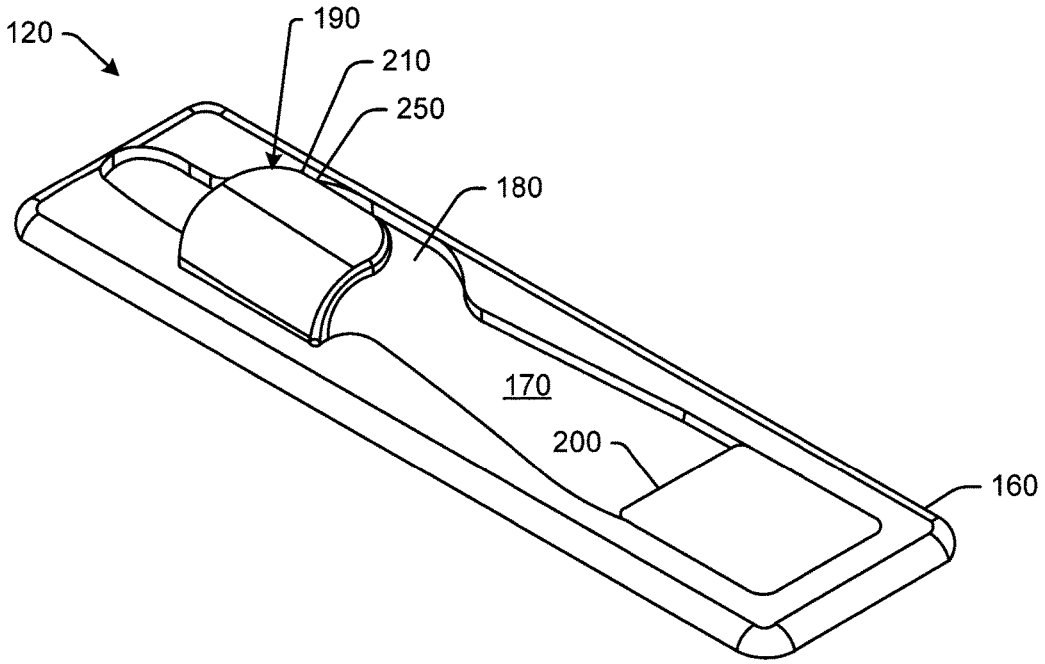
FIG. 3 is a perspective view of the front cover of the cutlery dispenser of FIG. 1.
Figure 4:
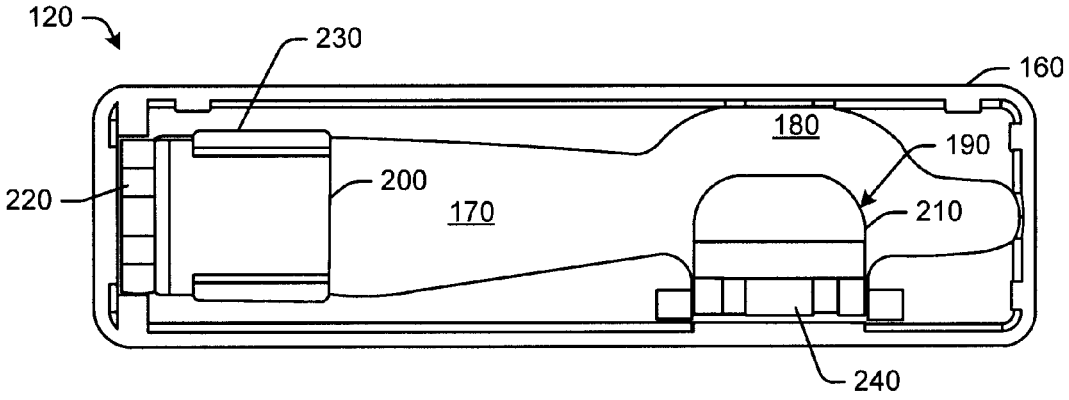
FIG. 4 is a plan view of the rear of the front cover of FIG. 3.

Referring now to the drawings, in which like numerals refer to like elements throughout the several views, FIG. 1 and FIG. 2 show an example of a cutlery dispenser 100 as may be described herein. The cutlery dispenser 100 may include a housing 110. The housing 110 may be enclosed by a front cover 120 on one end and an end cap 130 on the other. The cutlery dispenser 100, and the components thereof, may have any suitable size, shape, or configuration. Specifically, the cutlery dispenser 100, and the components thereof, may be sized to accommodate various types of cutlery utensils for loading therein and for dispensing therefrom. The cutlery dispensers 100, and the components thereof, may be made out of any suitable type of substantially rigid material including thermoplastic such as polypropylene, metals such as aluminum, composite materials, and the like. Different types of materials may be used herein together for the various components.

The cutlery dispenser 100 also may include a trough 140 and a guide 150 positioned within the housing 110. The trough 140 and the guide 150 may be largely "U" shaped and may be sized to accommodate the cutlery utensils therein. The trough 140 and the guide 150 may be integrally formed within the housing 110 and/or fixed therein. The trough 140 and the guide 150 may help maintain the orientation of the cutlery utensils during loading and dispensing. Other components and other configurations may be used herein.

FIGS. 2-5 show an example of the front cover 120. The front cover 120 may include a frame 160. The frame 160 may surround, in whole or in part, a dispensing opening 170. The frame 160 may be sized so as to mate or otherwise attach to the housing 110. The frame 160 may mate with the housing 110 in any convenient manner including a snap fit and/or for the use of suitable types of retainers. The dispensing opening 170 may be sized to allow a cutlery utensil to be loaded and dispensed therethrough although any suitable size, shape, or configuration may be used herein.

The dispensing opening 170 also may have one or more side notches 180 so as allow a cutlery utensil to be grasped therein.

The front cover 120 may include a number of retainers 190 attached to the frame 160 or otherwise. The retainers 190 may have any suitable size, shape, or configuration. In this example, a bottom retainer 200 and a side retainer 210 are shown. Any suitable number of retainers 190 may be used herein in any suitable position. The bottom retainer 200 may be attached to the frame 160 via a bottom retainer spring 220 or other type of pivoting device. The bottom retainer 200 may be largely flat with a pair of side flanges 230. The side flanges 230 may extend beyond the edges of the frame 160 so as to prevent forward movement of the bottom retainer 200 outside of the front of the frame 160. In a closed position, the front of the bottom retainer 200 may be substantially flush with the front of the frame 160. The bottom retainer 200 may have a sufficient length so as to maintain the cutlery utensils therein while allowing a first one to be removed through the dispensing opening 170.

Figure 5:
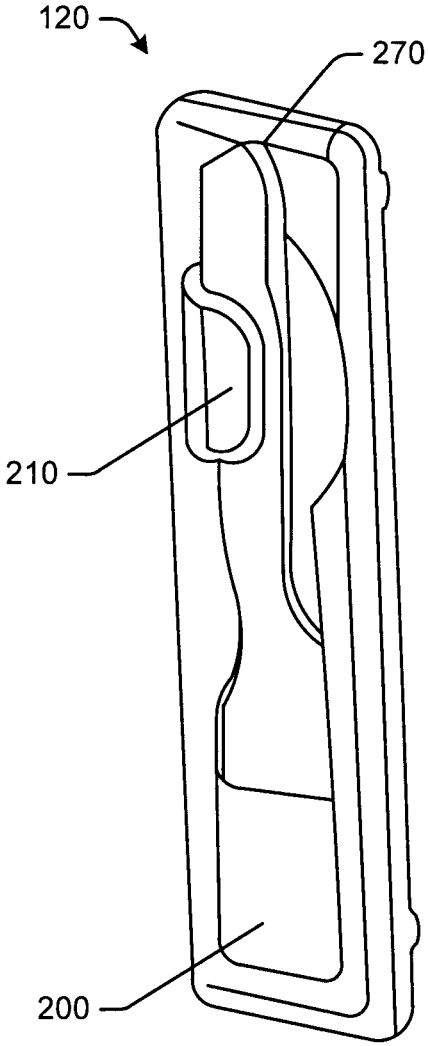
FIG. 5 is a perspective view of the front cover of FIG. 3 with a utensil therein.

The side retainer 210 may be positioned about the side notch 180 or elsewhere about the dispensing opening 170. The side retainer 210 may be attached to the frame via a side retainer spring 240 or other type of pivoting device. The side retainer 210 may have a substantially curved shape 250 extending outside of the frame 160. The curved shape 250 of the side retainer 210 supports the cutlery utensils therein with at least the first one leaning in a fanned position for easy removal. The side retainer 210 may have a sufficient width so as to maintain the remainder of the stack of cutlery utensils therein while allowing a first one to be removed through the dispensing opening 170. FIG. 5 shows the retainers 190 in a closed position with a cutlery utensil 270 positioned within the front cover 120. Other components and other configurations may be used herein.

Figure 6:
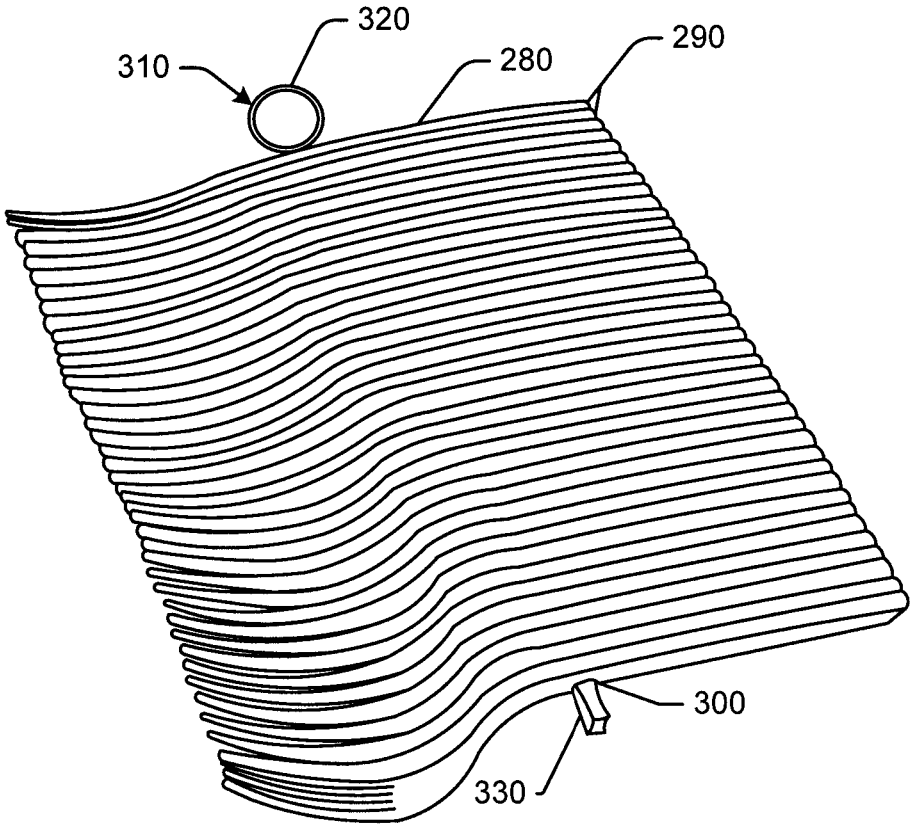
FIG. 6 is a perspective view of stack of utensils for use with the cutlery dispenser of FIG. 1.
Figure 7:
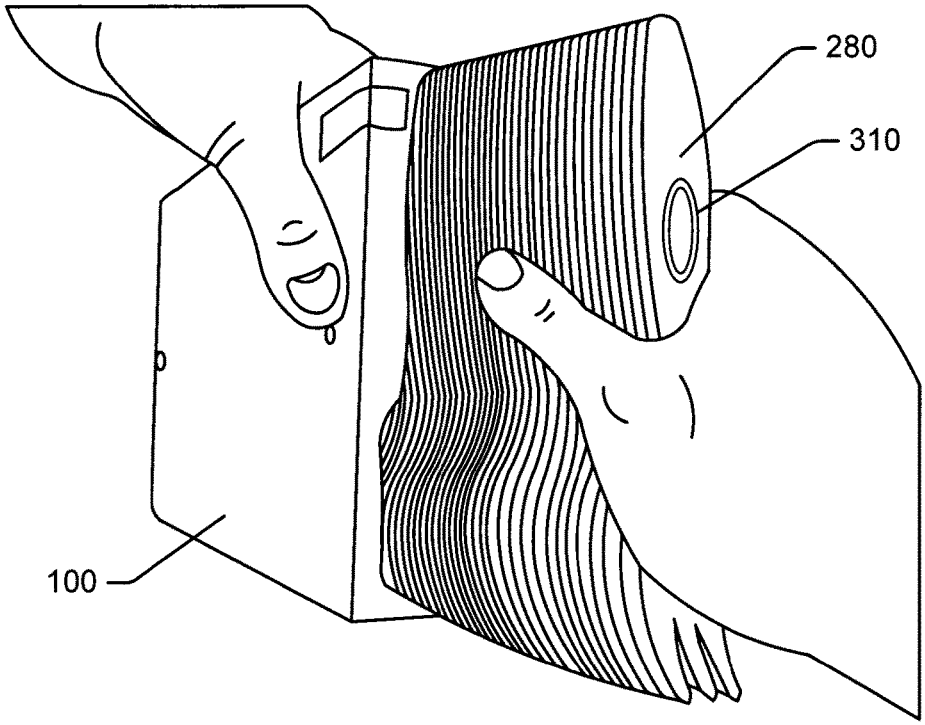
FIG. 7 is a perspective view showing the loading of the cutlery utensils in the cutlery dispenser of FIG. 1.
Figure 8:
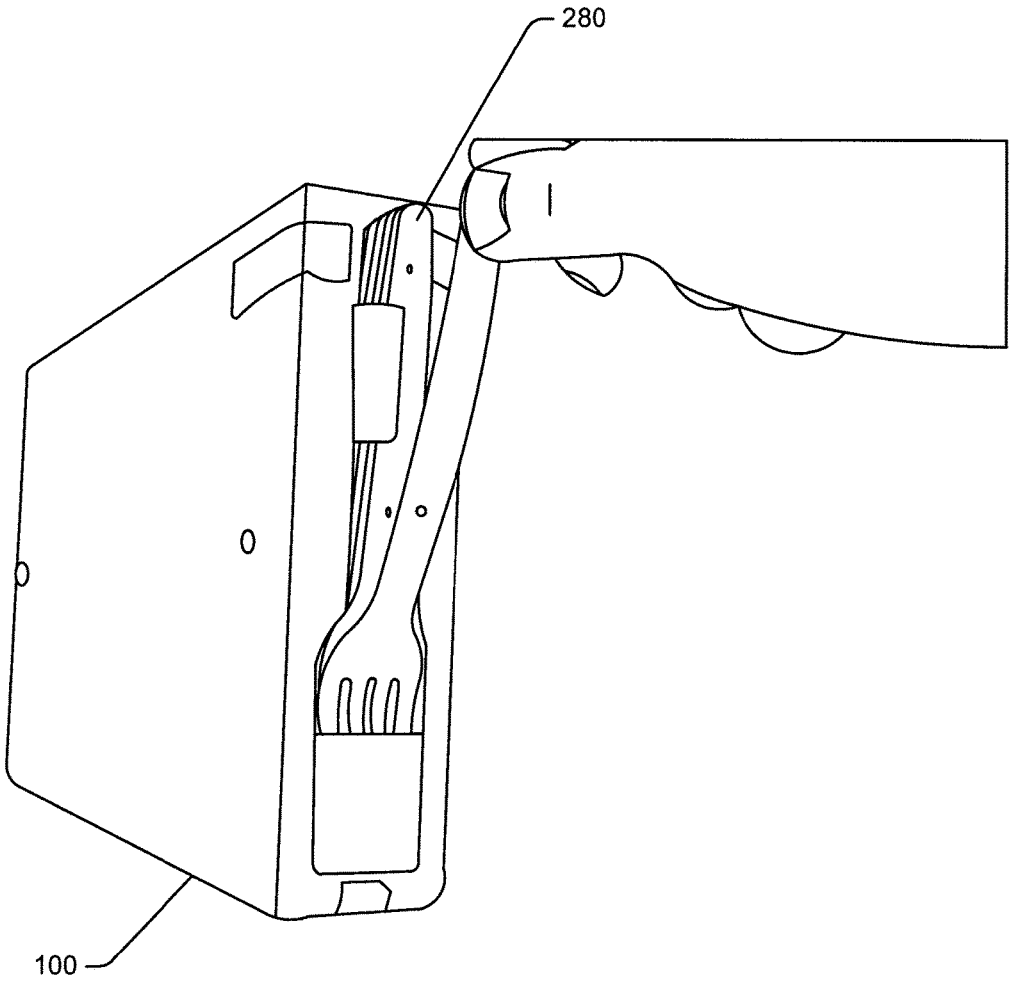
FIG. 8 is a perspective view showing the dispensing of a cutlery utensil from the cutlery dispenser of FIG. 1.

FIG. 6 and FIG. 7 show an example of a stack 280 of cutlery utensils 270. The stack 280 may be nested or otherwise oriented. In this example, the cutlery utensils 270 in the stack 280 are in the form of a number of forks 290 although any type of cutlery utensil may be used herein. The cutlery utensils 270 may have one or more skewer apertures 300 formed therein. The skewer apertures 300 may be sized and shaped for a skewer 310 or other type of a joinder member 315. Any type of joinder members 315 or other types of connection devices may be used herein. In this example, the skewer 310 may have a loop 320 at one end and a barb 330 and the like at the other. The skewer 310 may be positioned through the skewer apertures 300 of each utensil 270 in the stack of utensils 280. The stack 280 may be transported via the loop 320. Other components and other configurations may be used herein.

As is shown in FIG. 7, the stack 280 may be positioned within the cutlery dispenser 100 via the front cover 120. Specifically, the stack 280 may be pushed through the retainers 190 on the dispensing opening 170 of the front cover 120. Once the stack 280 is positioned within the housing 110, the retainers 190 may spring forward so as to maintain the stack 280 therein. The skewer 310 then may be removed from the stack 280. The cutlery utensils 270 are now available for dispensing. A consumer may grasp the first cutlery utensil 270 via the side notch 180 and remove the cutlery utensils 270 one by one or otherwise. The cutlery utensils 270 may have a fanned orientation about the dispensing opening 170 given the use of the curved shaped 250 of the side retainer 210 in coordination with the bottom retainer 200. Other components and other configurations also may be used herein.

Figure 9:
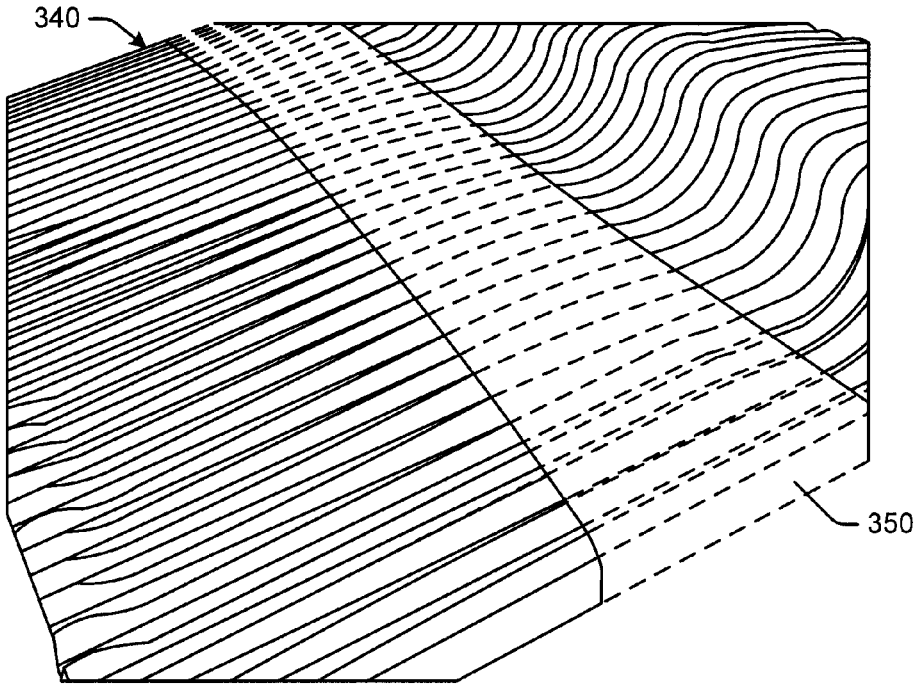
FIG. 9 is a partial perspective view of a stack of utensils for use with the cutlery dispenser of FIG. 1.

FIG. 9 shows a further embodiment of a stack of utensils 340. In this example, the stack 340 may be surrounded by a joinder member 315 in the form of a shrink band 350. The shrink band 350 may be made out of any type of suitable thermoplastic and the like. The shrink band 350 surrounds the stack 340 for transport. The stack 340 may be positioned within the cutlery dispenser 100 as is described above. Once the stack 340 is positioned therein, the shrink band 350 may be torn and removed therefrom. Other components and other configurations may be used herein.

Figure 10:
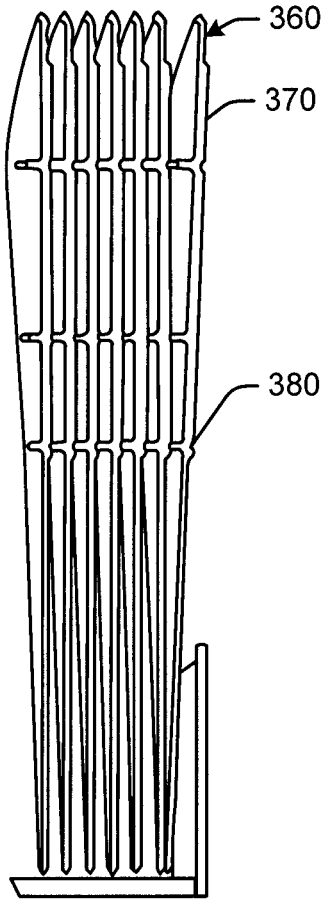
FIG. 10 is a side view of a stack of cutlery utensils for use with the cutlery dispenser of FIG. 1.

FIG. 10 shows a further example of a stack of cutlery utensils 360. In this example, the stack of cutlery utensils 360 may be a nested stack of knives 370. Other types of cutlery utensils may be used herein. The knives 370 may include one or more triangles of contact 380. The triangles of contact 380 produce an angle between the knives 370 and the stack 360 so as to accommodate the shrink band or other type of connection while also promoting a fanning position so as to make the front utensil easier to select and remove. Other components and other configurations also may be used herein.

Figure 11:
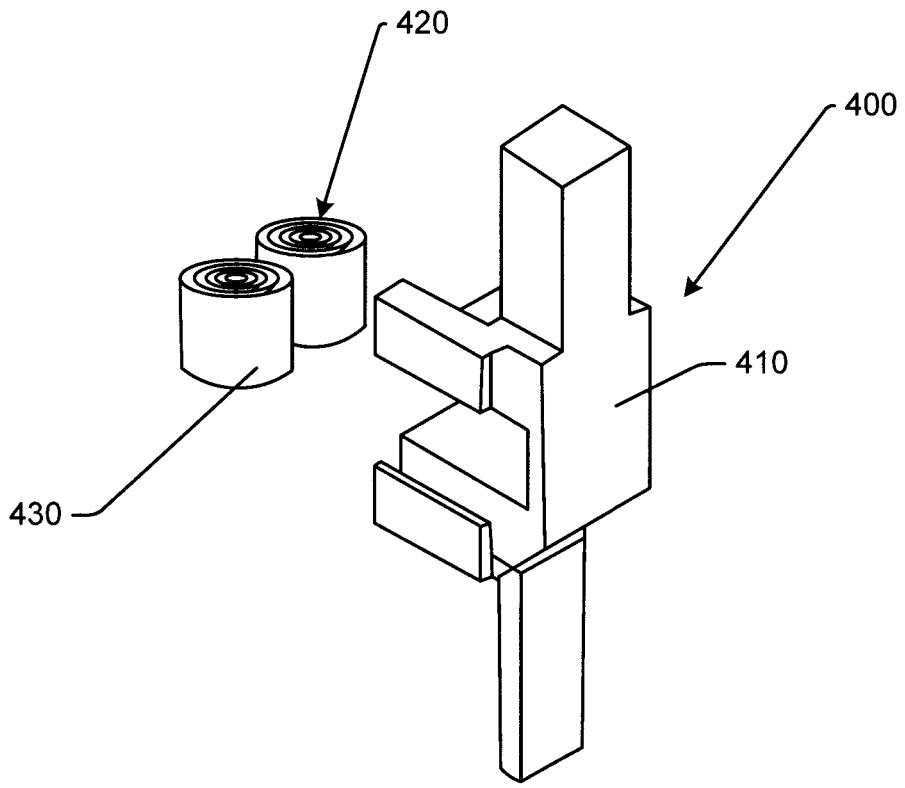
FIG. 11 is a perspective view of an example of a pushing assembly as may be used with the cutlery dispenser of FIG. 1.

The cutlery dispenser 110 also may include a pushing assembly 400. The pushing assembly 400 may assist in forcing the cutlery utensils towards the front cover 120 during dispensing. An example of a pushing assembly suitable for use herein is shown in commonly owned U.S. Patent Publication No. 2013/0143272 A1, entitled "Cutlery Dispenser" in the name of Oakes. U.S. Patent Publication No. 2013/0143272 A1 is incorporated by reference herein full. As is shown in FIG. 11, the pushing assembly 400 may include a support member 410 and at least one biasing member 420. The pushing assembly 400 may be supported within the housing 410 by aligning with the trough 140, the guide 150, or otherwise. The support member 410 may have any suitable size, shape, or configuration. The support member 410 may contact the cutlery utensils 270 while the biasing member 420 urges the support member 410 towards the front cover 120. The biasing member 420 may include springs, rubber bands, magnets, and the like. In this example, the biasing members 420 may be in the form of a pair of coil springs 430. Other types of pushing assemblies and the like may be used herein to urge the cutlery utensils 270 towards the front cover 120. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

What is claimed is:

1. A cutlery dispenser for use with a number of cutlery utensils, comprising:

a housing; and a front cover;

the front cover defining a dispensing opening and comprising a spring loaded retainer such that the number of cutlery utensils may be loaded through the dispensing opening and past the spring loaded retainer on the front cover into the housing and may be dispensed out of the dispensing opening.

2. The cutlery dispenser of claim 1, wherein the housing comprises a horizontal trough therein.

3. The cutlery dispenser of claim 2, wherein the housing comprises a guide therein positioned over the trough.

4. The cutlery dispenser of claim 1, wherein the housing comprises an end cap positioned parallel to the front cover.

5. The cutlery dispenser of claim 1, wherein the front cover comprises a frame surrounding the dispensing opening in whole or in part.

6. The cutlery dispenser of claim 5, wherein the frame defines one or more side notches in the dispensing opening for one of the number of cutlery utensils to be grasped therein.

7. The cutlery dispenser of claim 1, wherein the spring loaded retainer comprises a bottom retainer positioned about the dispensing opening.

8. The cutlery dispenser of claim 7, wherein the bottom retainer comprises a bottom retainer spring.

9. The cutlery dispenser of claim 7, wherein the bottom retainer comprises a side flange extending beyond an edge of the dispensing opening.

10. The cutlery dispenser of claim 1, wherein the spring loaded retainer comprises a side retainer positioned about the dispensing opening.

11. The cutlery dispenser of claim 10, wherein the side retainer comprises a side retainer spring.

12. The cutlery dispenser of claim 10, wherein the side retainer comprises a curved shape to retain the number of cutlery utensils within the housing.

13. The cutlery dispenser of claim 1, wherein the housing comprises a horizontal pushing assembly.

14. The cutlery dispenser of claim 1, wherein the number of utensils comprises a stack positioned along a horizontal axis.

15. A method of dispensing cutlery utensils from a dispenser, comprising:

arranging the cutlery utensils in a stack via a joinder member;

loading the stack into a dispensing opening defined through a front cover of the dispenser;

pivoting a retainer into a first position along the front cover while the stack is pushed beyond the retainer;

pivoting the retainer into a second position once the stack is within the dispenser;

removing the joinder member from the stack; and dispensing the cutlery utensils through the dispensing opening on the front cover.

16. A cutlery dispenser, comprising:

a housing;

a stack of cutlery utensils;

a dispensing opening defined through a front cover; and a spring loaded retainer positioned about the dispensing opening such that the stack of cutlery utensils may pivot the spring loaded retainer so as to be loaded through the dispensing opening into the housing and then be dispensed out of the dispensing opening.

17. The cutlery dispenser of claim 16, wherein the stack of cutlery utensils comprises a joinder member.

18. The cutlery dispenser of claim 17, wherein the joinder member comprises a skewer.

19. The cutlery dispenser of claim 17, wherein the joinder member comprises a shrink band.

20. The cutlery dispenser of claim 16, wherein the stack of cutlery utensils comprises a plurality of cutlery utensils with one or more triangles of contact.

* * * * *